US006626707B2

(12) United States Patent
Henrici et al.

(10) Patent No.: US 6,626,707 B2
(45) Date of Patent: Sep. 30, 2003

(54) TWO-PART HOLDER FOR HIGH-VOLTAGE LAMP

(75) Inventors: Dieter Henrici, Arnsberg (DE); Erwin Lingemann, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 10/291,188

(22) Filed: Nov. 8, 2002

(65) Prior Publication Data

US 2003/0119375 A1 Jun. 26, 2003

(30) Foreign Application Priority Data

Dec. 21, 2001 (DE) ..... 101 63 057

(51) Int. Cl.[7] ..... H01R 24/00; H01R 33/00
(52) U.S. Cl. ..... 439/699.2; 362/226
(58) Field of Search ..... 439/699.2, 619, 439/701, 356, 360; 362/226, 389

(56) References Cited

U.S. PATENT DOCUMENTS 4,100,448 A * 7/1978 Chipner et al. ..... 313/318.11
6,039,579 A * 3/2000 Paul et al. ..... 439/56
6,080,019 A * 6/2000 Coushaine ..... 439/611
6,254,252 B1 * 7/2001 Coushaine et al. ..... 362/226
6,296,529 B2 * 10/2001 Tanigawa ..... 439/699.2

* cited by examiner

*Primary Examiner*—Chandrika Prasad
(74) *Attorney, Agent, or Firm*—Herbert Dubno

(57) ABSTRACT

A lampholder has an outer sleeve centered on an axis and having a radially inwardly projecting lug having an axially inwardly directed end face and an inner core adapted to fit with a lamp, fittable inside the sleeve, and formed with an axially inwardly directed face axially alignable and engageable with the outer-sleeve end face on rotation of the core in the sleeve in a predetermined sense in a fully inserted position of the inner core in the sleeve. Interengageable retaining formations on the core and on the sleeve inhibit rotation of the core in the sleeve opposite to the predetermined sense when the faces are axially aligned with and engage each other.

9 Claims, 1 Drawing Sheet

TWO-PART HOLDER FOR HIGH-VOLTAGE LAMP

FIELD OF THE INVENTION

The present invention relates to lampholder. More particularly this invention concerns two-part holder for a high-voltage lamp.

BACKGROUND OF THE INVENTION

A standard two-part holder for a high-voltage lamp has a core or insert part into which the lamp end is fitted, and an outer part into which the core part is in turn fitted. Appropriate formations interconnect the two parts and connections and terminals are provided to conduct electricity from outside the outer part to contacts on the lamp in the core part.

In one known such lampholder the outer part is provided with an external screwthread for mounting it in a light fixture or for mounting a shade or globe on it. This outer part has on its outer end toward the lamp a pair of diametrally opposite spring hooks that can snap into engagement with opposite shoulders of the core part that is fitted axially into it. Since the outer part is made of plastic, there is typically considerable play between it and the core part which projects considerably from the outer part which engages around only its end portion. The lamp is therefore not solidly mounted, and the electrical connections to it are poorly shielded.

Another known system has an outer part formed as a cup or sleeve from whose walls are cut a pair of diametrally opposite and inwardly projecting tongues. When the core part is inserted into this outer part, the tongues are spread, and once the core part is fully inserted they click into place in front of outwardly directed shoulders on the core to lock it in place. While such a lampholder does hold the insert or core part more solidly, it has radially throughgoing slots around the deflectable retaining tongues, and these slots present a possible shock hazard.

When such a lampholder is designed for use with a halogen lamp that gets very hot, it is necessary to make the lampholder of a highly heat-resistant material. Plastics such as polyphenyl sulfide (PPS) or liquid crystal polymer (LCP), which art stable at temperatures up to 270° C., are used, as well as some ceramics. The problem with these materials is that they are quite brittle. Thus the deformation of fitting them together can damage them. Furthermore to remove the core, it is necessary to insert a tool between it and the outer part to pry back the retaining formations, and this can damage both parts. In addition when such lampholders are used with high-voltage lamps, they cannot have any perforations, as for instance made when the core is held in place by integral, cut-out fingers, so that such construction is ruled out or a separate insulation sleeve must be provided.

OBJECTS OF THE INVENTION

It is therefore an object of the present invention to provide an improved two-part holder for a high-voltage lamp.

Another object is the provision of such an improved two-part holder for a high-voltage lamp which overcomes the above-given disadvantages, that is which is of simple durable construction, and that is completely closed for use with a high-voltage lamp.

SUMMARY OF THE INVENTION

A lampholder has according to the invention an outer sleeve centered on an axis and having a radially inwardly projecting lug having an axially inwardly directed end face and an inner core adapted to fit with a lamp, fittable inside the sleeve, and formed with an axially inwardly directed face axially alignable and engageable with the outer-sleeve end face on rotation of the core in the sleeve in a predetermined sense in a fully inserted position of the inner core in the sleeve. Interengageable retaining formations on the core and on the sleeve inhibit rotation of the core in the sleeve opposite to the predetermined sense when the faces are axially aligned with and engage each other.

Thus the core and sleeve are connected together by an integral bayonet joint. Such a connection does not rely on deformation of the parts, made of a high-temperature-resistant plastic for instance, so that damage to them is unlikely. Such a bayonet joint can however resist considerable separation forces so that when the lamp must be replaced, it can simply be pulled out of the core and a new one inserted, with no worry of the core stripping out of the sleeve. What is more, fitting them together is a relatively simple task involving axially sliding the insert into the sleeve, then rotating it through a small angle until the two faces are aligned and the retaining formations fit together.

The lug according to the invention is recessed in the sleeve and the sleeve is radially imperforate. Thus the lampholder according to the invention can be used with a high-voltage lamp, for instance a halogen bulb. There are no punched-out retaining tongues that could create a shock risk.

The sleeve in accordance with the invention is further formed adjacent the inwardly directed face with an axially extending and radially outwardly open groove along which the lug can move axially on axial inward insertion of the core into the sleeve. Furthermore the interengageable retaining formations include a radially inwardly projecting formation on the sleeve and a radially outwardly projecting formations on the core. Each of the formations has a edge face extending in a plane generally parallel to and radial of the axis and an opposite angled cam surface. The cam surfaces allow the formations to pass each other on rotation in the predetermined installing direction, while the edge faces prevent opposite rotation. The formation of the core is immediately adjacent the groove, in fact it defines one edge of the groove.

The sleeve according to the invention is formed with an external screwthread, preferably measuring 20.8 mm×2 mm. Such a screwthread is standard in low-volt lamps, so that the lampholder according to the invention can accept standard gloves and fit in standard installations.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
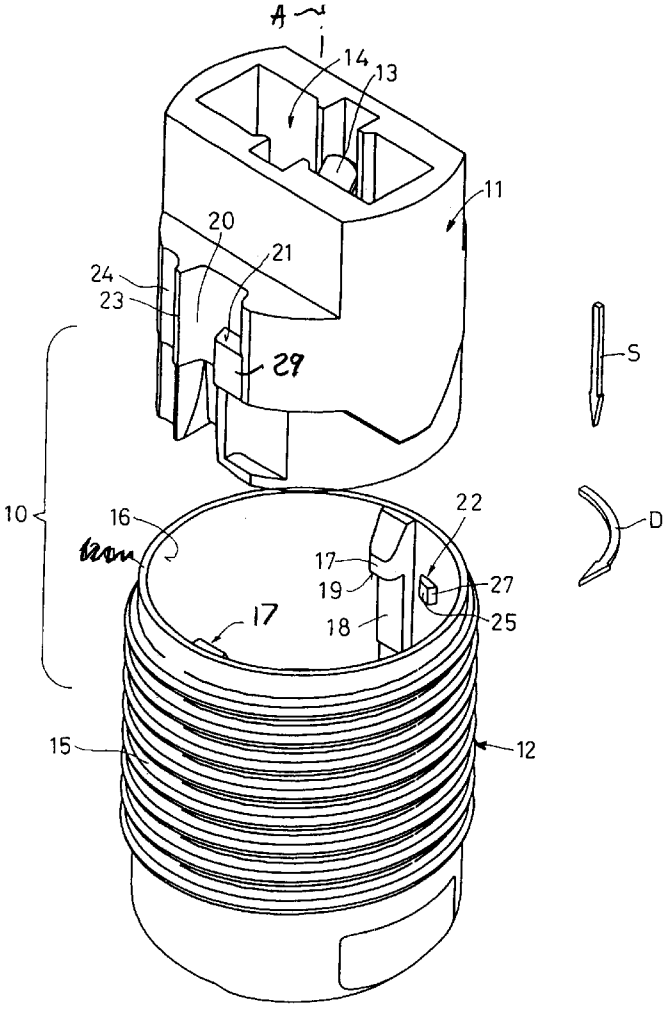
FIG. 1 is an exploded perspective view of the lampholder according to the invention.

As seen in FIG. 1 a lampholder 10 according to the invention basically comprises a hard-plastic insert or core part 11 and a hard-plastic outer sleeve part 12, both centered on an axis A. The insert 11 is formed of polyphenyl sulfide with a socket or seat 14 adapted to hold the end of a lamp, here a halogen bulb, and is provided with retaining clips 13 that hold the unillustrated bulb in the seat 14. Unillustrated contacts make electrical contact with it. The outer part 15 is formed with a coarse 20.8×2 mm external screwthread 15 so that a standard shade or globe can be mounted on it. As will be described below, the insert 11 is fitted to the sleeve 12 by pushing it axially downward as indicated by arrow S, then rotating it somewhat about the axis A as shown by arrow D.

The outer part 12 is formed as an imperforate sleeve with no radially throughgoing apertures so that it can be used with a high-voltage lamp. It has a smooth cylindrical inner surface 16 formed with a pair of diametrally opposite, axially extending, and radially inwardly projecting ridges or ribs 13 each formed in turn toward its outer end with a radially inwardly projecting lug 17 having a planar axially inwardly directed shoulder face 19 lying in a plane perpendicular to the axis A. Next to each of the ridges 19 is a retaining formation or bump 22 having an edge face 27 laying in a plane extending generally radially of and parallel to the axis A and an opposite angled cam surface 25.

The insert 11 is formed with a pair of diametrally opposite, axially extending, and radially outwardly opening grooves 20 into each of which projects a bump 29 having an outwardly directed face 21. Each groove 20 has an edge face 28 lying on a plane extending axially and generally radially of the axis A. Next to each of the bumps 29 is a radially outwardly open groove 24 having an angled cam surface 26, separated from the respective groove 20 by a lip 23.

Figure 2:
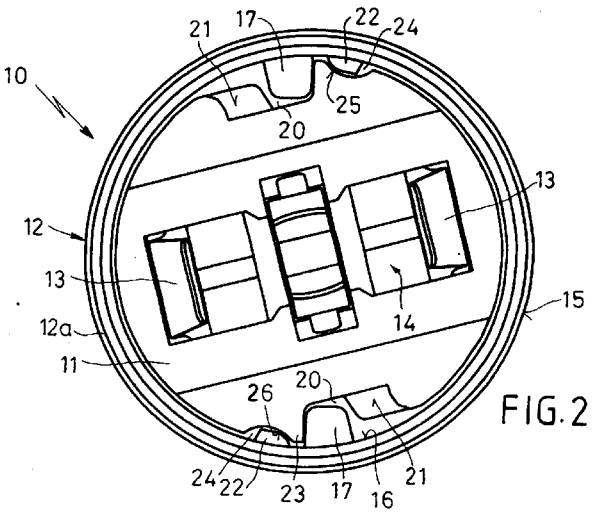
FIGS. 2 and 3 are end views of the lampholder in partially assembled and fully assembled positions.
Figure 3:
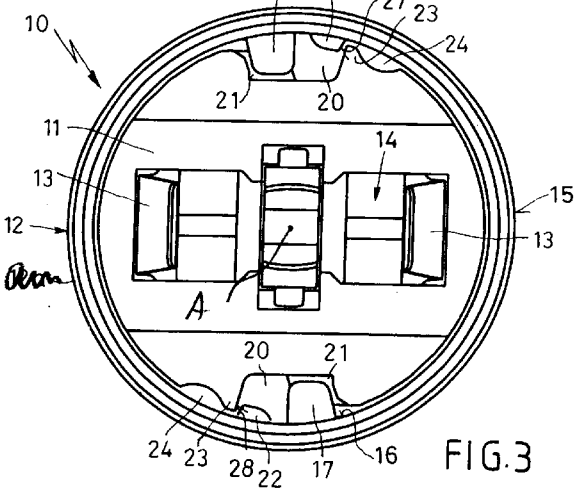

The lampholder 10 is assembled by pushing the insert 11 in direction S into the sleeve 12 with the lugs 17 moving down in the grooves 20 adjacent the bumps 29 and the bumps 22 moving down in the grooves 24 as shown in FIG. 2. Once the faces 21 of the bumps 29 are past the faces 19 of the ridges 18, the insert 11 is rotated as indicated by arrow D, which has two effects. First, the faces 21 move under the faces 19 to prevent any further outward movement of the insert 11, locking it in the sleeve 12. Second, the bumps 22 move from the grooves 24 past the lips 23, with modest elastic deformation of the sleeve 12 caused by engagement of the angled cam surfaces 25 and 26 with each other until the faces 27 and 28 pass each other and the parts 11 and 12 assume the end position of FIG. 3. In this end position reverse rotation of the insert 11 in the sleeve 12 against the direction D is essentially impossible since the faces 27 and 28 abut each other flatly.

Of course, if it is necessary to remove the insert 11, a user can insert a tool between each of the lips 23 and the sleeve 12 to spread them enough to allow the bumps 22 to pass back into the grooves 24. The bumps 22 only project by a few tenths of a millimeter, so that the radial deformation of the sleeve 12 when the bump 22 passes the lip 23 is minor and not likely to damage the brittle plastic of the sleeve 12.

We claim:

1. A lampholder comprising:

an outer sleeve centered on an axis and having a radially inwardly projecting lug having an axially inwardly directed end face;

an inner core adapted to mate with a lamp, fittable axially inside the sleeve, and formed with an axially outwardly directed face, the core being rotatable about the axis when fully inserted into the sleeve between a first position in which the outwardly directed inner-core face is angularly offset from the inwardly directed outer-sleeve end face and a second position in which the outwardly directed inner-core face is axially aligned and engaged with the inwardly directed outer-sleeve end face; and interengageable retaining formations on the core and on the sleeve inhibiting rotation of the core in the sleeve from the second position to the first position.

2. The lampholder defined in claim 1 wherein the lug is recessed in the sleeve.

3. The lampholder defined in claim 1 wherein the sleeve is radially imperforate.

4. The lampholder defined in claim 1 wherein the core is further formed adjacent the outwardly directed face with an axially extending and radially outwardly open groove along which the lug can move axially on axial inward insertion of the core into the sleeve.

5. The lampholder defined in claim 4 wherein the interengageable retaining formations include a radially inwardly projecting formation on the sleeve and a radially outwardly projecting formations on the core.

6. The lampholder defined in claim 5 wherein each of the interengageable retaining formations has a edge face extending in a plane generally parallel to and radial of the axis, and an opposite angled cam surface.

7. The lampholder defined in claim 6 wherein the formation of the core is immediately adjacent the groove.

8. The lampholder defined in claim 1 wherein the sleeve is formed with an external screwthread.

9. The lampholder defined in claim 8 wherein the screwthread is 20.8 mm×2 mm.

* * * * *